United States Patent [19]

Fleischer et al.

[11] Patent Number: 4,798,631

[45] Date of Patent: Jan. 17, 1989

[54] METALLIC SEMI-FINISHED PRODUCT, PROCESSES FOR ITS PREPARATION AND ITS USE

[75] Inventors: Hans-Joachim Fleischer, Velbert; Klaus Lohscheidt, Krefeld; Dieter Görres, Haan; Friedrich Behr, Essen, all of Fed. Rep. of Germany

[73] Assignee: Thyssen Aktiengesellschaft vorm August Thyssen-Hutte, Duisburg, Fed. Rep. of Germany

[21] Appl. No.: 18,545

[22] Filed: Feb. 25, 1987

[30] Foreign Application Priority Data

Mar. 1, 1986 [DE] Fed. Rep. of Germany ..... 3606804

[51] Int. Cl.[4] ..... C21D 9/00

[52] U.S. Cl. ..... 148/3; 148/16; 148/325; 148/327; 148/428; 148/425

[58] Field of Search ..... 148/3, 16, 20.3, 306, 148/310, 311, 325, 312, 313, 327, 428, 425; 164/477

[56] References Cited

U.S. PATENT DOCUMENTS 4,414,023 11/1983 Aggen et al. ..... 420/40

FOREIGN PATENT DOCUMENTS 2063723 6/1981 United Kingdom .

OTHER PUBLICATIONS

Strafford K. N., "High Temperature Corrosion of Alloys Containing Rare Earth or Refractory Elements: a review . . . " *High Temperature Technology,* vol. 1, No. 6, Nov. 1983.

*Primary Examiner*—Deborah Yee

*Attorney, Agent, or Firm*—Sprung Horn Kramer & Woods

[57] ABSTRACT

The invention relates to a metallic semi-finished product based on iron and/or nickel and/or cobalt and containing 2 to 16% of aluminum, 12 to 30% of chromium and at least one highly reactive element X, in particular from the group consisting of the rare earth metals and/or their dispersed oxides. The characteristic feature of the invention is that metallic columnar crystals are formed at least in the surface region of the semi-finished product and columnar crystals consisting predominantly of aluminum oxide and/or chromium oxide grow out of the said metallic columnar crystals, the axes of the two types of columnar crystals being predominantly at right angles to the geometric surface of the semi-finished product.

13 Claims, 1 Drawing Sheet

METALLIC SEMI-FINISHED PRODUCT, PROCESSES FOR ITS PREPARATION AND ITS USE

The invention relates to a metallic semi-finished product in the form of wire, rods, billets, pipes or in particular sheets or strips, for applications in which high stability to thermal cycling and a large surface area and/or chemical stability and/or low thermal conductivity of the surface layer are required, in particular for catalyst supports carbon black filters, heating elements, aerosol filters and linings of chemical plants and energy-converting plants, and a process for its production are proposed.

The invention especially relates to a metallic semi-finished product based on iron and/or nickel and/or cobalt and containing 2 to 16% of aluminum, 12 to 30% of chromium and up to 4% of at least one highly reactive element from the group consisting of Y, Zr, Ti, Ce, Sm, Hf, La, Th, U, V, W, Ta, Nb, Mo, Gd, Si, Mg, Ca and/or their dispersed oxides, and normal steelmaking impurities.

BACKGROUND OF THE INVENTION

It is known (Strafford K. N., "High temperature Corrosion of alloys containing rare earth or refractory elements: a review . . . ," High Temperature Technology Vol. 1, No. 6, November 1983) that metallic alloys of the type MCrALX and of the type MCrALZX, where M is iron and/or cobalt and/or nickel and X represents small amounts by weight of added highly reactive elements, such as Y, Zr, Ti, Ce, Sm, Hf, La, Th, U, V, W, Ta, Nb, Mo, Gd, Si, Mg or Ca, and Z is an element, or an oxide thereof, from the series comprising X but is a different element from that chosen in each case for X, improve the properties of the oxide layer. Adhesion of the oxide layer, which consists of individual oxide particles, is improved, and the oxidation behavior is advantageously affected.

It is also known (Ramanarayan T. A., Raghavan, M. and Petkovic-Luton, R., "The Characteristics of Alumina Scales formed on Fe-Based Yttria-Dispersed Alloys", *J. Electrochem.* Society, April 1984, Vol. 131 No. 4., 923–931) that particularly finely dispersed oxides of the rare earths, such as $Y_2O_3$, produce a similar improvement in a base alloy.

The alloys mentioned are known to form either layers consisting predominantly of chromium oxide or aluminum oxide, with selectivity, or layers consisting of $Al_2O_3$/chromium oxide mixed crystals, depending on the composition. Where the temperatures used are about 900° C. or higher, the alloys which form $Al_2O_3$ layers are chosen.

Where their use entails particularly frequent temperature changes with high temperature differences, the disadvantage of the layers and components consisting of the alloys described and produced by the process described is that scaling of individual areas of the oxide layer takes place. Although the defects thus produced are eliminated again by the stated alloys under suitable conditions, the occurrence of scaling during intensive thermocycling restricts the useful life and makes the materials known today unsuitable for some applications, for example as supports for catalytically active substances, in particular noble metals, for the detoxification of combustion gases.

Another disadvantage is that alloys containing more than about 6% of aluminum, according to U.S. Pat. No. 4,414,023 discussed below, cannot be produced in the form of foil by rolling, or the production of this foil entails substantial costs. For long-term thermal stability, however, elimination of defects in the oxide layers by additional aluminum to be supplied from the alloy is necessary, and as high an Al content as possible is also useful.

U.S. Pat. No. 4,414,023 discloses a ferritic stainless steel alloy which is hot workable and is resistant to thermal cyclic oxidation and scaling at elevated temperatures. The iron-chromium-aluminum alloy contains cerium, lanthanum and other rare earths and is suitable for forming thereon an adherent textured aluminum oxide surface.

In making this alloy, a melt is prepared in a conventional manner. Preferably, the normal steelmaking impurities of oxygen, nitrogen and sulfur are reduced prior to the addition of rare earths to the melt. Any conventional processes, including electric arc furnaces, AOD and vacuum induction melting processes, are acceptable. The melt is then cast into ingots, bars, strips or sheets. The steel is subsequently hot and/or cold rolled and subjected to conventional processes such as descaling and heating prior to fabrication into the desired shape. The ferritic stainless steel is then heat-treated to form an aluminum oxide surface.

The object of the invention is to provide a metallic semi-finished product which, preferably in the absence of a wash coat, constitutes a substrate for a catalytically active coating, the said substrate being stable to thermal cycling. A further object is to provide a process which leads in as simple a manner as possible to a metallic semi-finished product having the stated property.

SUMMARY OF THE INVENTION

A metallic semi-finished product based on iron and/or nickel and/or cobalt and containing 2 to 16% of aluminum, 12 to 30% of chromium and up to 4%, e.g. 0.01 to 4% of at least one highly reactive element from the group consisting of Y, Zr, Ti, Ce, Sm, Hf, La, Th, U, V, W, Ta, Nb, Mo, Gd, Si, Mg, Ca and/or their dispersed oxides, and normal steelmaking impurities, is proposed wherein according to the inventIon, metallic columnar crystals are formed at least in the surface region of the semi-finished product and columnar crystals consisting predominantly of aluminum oxide and/or chromium oxide grow out of the said metallic columnar crystals, the axes of the two types of columnar crystals being predominantly at right angles to the geometric surface of the semi-finished product. Normal steelmaking impurities are, for example, carbon, nitrogen, oxygen, phosphorus, sulfur, manganese, copper and nickel.

The surface structure is clearly recognizable from the attached pictures of ground sections.

Figure 1:
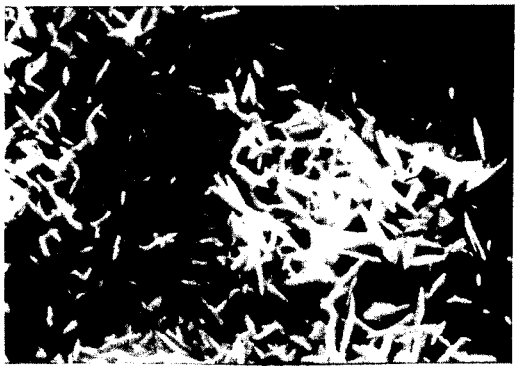
FIG. 1 shows the surface of a semi-finished product which has been produced by conventional methods and has irregularly positioned columnar oxide crystals.
Figure 2:
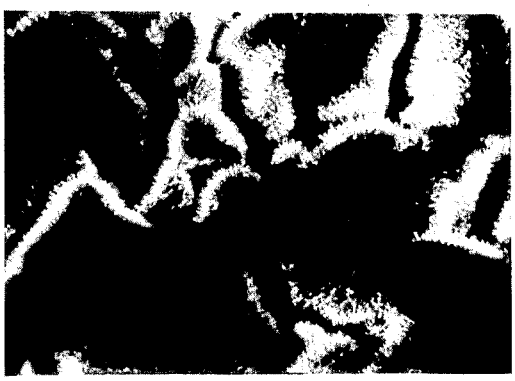
FIG. 2 shows the surface of the semi-finished product, as formed when the process according to the invention explained in detail below is used. The large areas are the metallic columnar crystals from whose surface the hair-like columnar oxide crystals grow.
Figure 3:
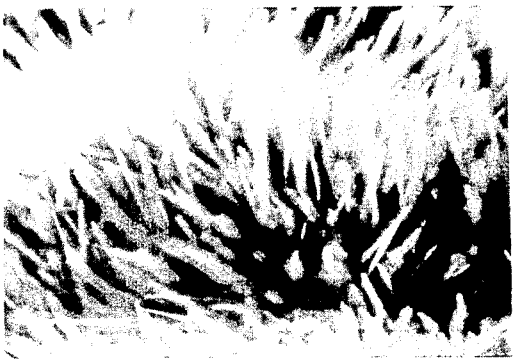
FIG. 3 shows the columnar oxide crystals magnified ten times compared with FIG. 2. In this figure, the axes of the columnar oxide crystals are predominantly at right angles to the geometric surface of the semifinished product, this surface being formed by the surfaces of the metallic columnar crystals.

Contents of 14 to 25% of chromium and 5 to 9% of aluminum in the matrix of iron and/or nickel and/or cobalt have proven particularly suitable for forming the columnar oxide crystals, which predominantly consist of aluminum oxide and chromium oxide or, depending on the annealing conditions, virtually exclusively of aluminum oxide. Other elements which do not have an adverse effect on the formation of the columnar crystals or even promote it may be present in addition to the stated elements.

The mean particle diameter D of the metallic columnar crystals should preferably be 5 to 50 μm. Depending on the alloy and wall thickness, the cooling rate is preferably chosen so that the mean particle diameter D is 5 to 30 μm. The length L of the particles should be 15 μm up to the thickness of the strip, preferably 20 to 100 μm, with $L:D \geqq 3$.

It has been found that, because of the crystallographically predominantly uniform orientation of the particles of the metallic structure, oxide particles which are close together but discrete and which have a diameter d of 0.05 to 3 μm, depending on the conditions of growth, and lengths of 0.5 to 15 μm, with $l:d \geqq 3$, are formed.

In the process according to the invention, the semi-finished product is solidified from the molten state in a front predominantly parallel to the geometric surface at a cooling rate of $10^3$ to $10^6$ K/s, and then annealed, initially at a temperature of 800° to 1000° C. for a short time in a gas containing oxygen in bound form, in particular $CO_2$, under the resulting reducing conditions, and then in the temperature range from 800° 0 to 1000° C. for up to 25 hours in the air. The semi-finished product can be solidified by strip casting by means of at least one cooled roll or by continuous casting. It may be surface melted and cooled, cooling being effected in air or inert gas or under vacuum.

Advantageously the annealing in under reducing conditions is carried out at a temperature in the range from 880° to 980° C. for 0.5 and 4 minutes, and the annealing in air is carried out at a temperature in the range from 850° to 1000° C. for 4 to 20 hours.

The invention provides a metallic semi-finished product in which, at least in the surface region, the oriented solidification of the metal alloy results in the formation of metallic columnar crystallites, and, because of the high cooling rate and thermal treatment, the additional elements from the abovementioned group X, which are highly reactive, ie. have a high affinity for oxygen, or their oxides, are present in finely divided form in the surface region and act as nuclei in the subsequent heat treatment and at the same time as a kind of plug, providing good adhesion for the columnar oxide crystallites subsequently grown by a thermal process. Further improved nucleation is achieved by virtue of the fact that, as a first thermal treatment stage, heating is carried out for a short time under reducing conditions or under the reducing conditions established during this treatment. This is followed by the prolonged annealing treatment under oxidizing conditions, preferably in the air, during which the columnar oxide crystallites grow, these crystallites predominantly consisting of aluminum oxide and/or chromium oxide and their axes likewise predominantly being at right angles to the geometric surface of the semi-finished product. The formation of these columnar crystals results in an extremely large surface area, in which a metallic and/or ceramic coating can be very firmly anchored.

The size of the particles of the metal structure is determined by the cooling rate and the heat content of the metal melt. To produce strips of about 50 μm thickness, as required, for example, as supports for exhaust gas catalysts for automobiles and power stations, it has proven advantageous to employ an apparatus in which one or two rolls are arranged under a crucible which has a long, thin slot as a die, this slot being kept open, if necessary, with the aid of a chamfered ceramic stopper rod. The peripheral surface of the roll or rolls may have a predetermined waviness so that the metal jet solidifies in the geometrical form required for the intended use, on the single roll or in the predetermined nip between the two rolls. The arrangement has the following advantages:

the metal strip essentially no longer requires to be subjected to plastic deformation; areas of plastic deformation are known to lead to uncontrolled growth of the particles of the metal structure in the subsequent treatment steps at elevated temperatures and hence to an irregular shape of the particles in the oxide layer;

the roll or rolls can be made of a material, such as steel or a ceramic, which has a lower thermal conductivity than that required for the production of amorphous strips with copper rolls;

the roll or rolls are, if necessary, kept at a predetermined temperature with the aid of heated, circulating oil, with the result that, in this way, the desired crystal size of the metal structure is established and a special thermal after-treatment to adjust the particle size can be dispensed with.

It has now been found that, in this way, it is possible to produce profiled, finely crystalline strips of about 20 to 200 μm, and with the aid of cooled copper rolls possibly also up to about 500 μm or more. Preferably, strips about 40 to 70 μm thick are produced.

Thus, it is possible in this way to produce aluminum oxide layers which consist of individual oxide particles which are separate from one another but have grown with substantially the same shape and have a diameter d of, preferably, 0.1 to 0.3 μm, and a length l of 4 to 15 μm, so that catalytically active substances can be deposited thereon without the need for an additional wash coat, as, for example, in the case of pure oxide catalyst supports.

The outlined formation of columnar crystals at least in the surface region of the semi-finished product can, as an alternative to the abovementioned casting on cooled rollers, also be achieved by melting a surface layer of the cast or rolled semi-finished product for a short time, followed by self-cooling.

The invention is illustrated by the following examples.

EXAMPLE 1

A metal strip 50 μm thick was produced at a cooling rate of $10^5$ to $10^4$ K/s, using a steel roll which was kept at a constant temperature by means of an oil circulation. The material was composed of 20% of chromium, 5% of aluminum, 0.15% of cerium and 0.01% of lanthanum, the remainder being iron together with small amounts of Si, Mn, C, S, P and Ni as trace elements.

The strip was then subjected to a heat pretreatment at 900° C. for one minute with dry carbon dioxide gas and then kept in the air at 925° C. for sixteen hours. A cold-rolled foil having the same composition was treated in the same manner after recrystallization annealing.

It is found that the columnar oxide particles of the cast strip have diameters of about 0.2 μm and mean lengths of about 4 μm and are virtually all arranged at right angles to the surface of the metal particles, whereas the sample produced by rolling has scale-like particles which have different orientations and lengths of up to about 3 μm and some of which are in contact witn one another.

EXAMPLE 2

A 10 mm thick sheet of the material described in Example 1 was bombarded with an electron beam in such a way that a spot of about 0.5 mm in diameter and up to 100 μm deep was melted. The sheet was then treated in $CO_2$ gas for 1 minute at 900° C. The further procedure was as described in Example 1.

It was found that the oxide particles or whiskers produced in the region of the fused spot had a quality similar to that of the cast sample according to Example 1.

The sample was subjected to several temperature changes, preheated to about 1000° C. and quenched in an oil bath. The columnar oxide particles in the region of the fused spot were not attacked by the treatment, while the oxide layer of the remaining surface of the sample showed isolated scaling.

EXAMPLE 3

A sheet according to Example 2 and having a similar fused spot was produced, and etching was then carried out so that the particle boundaries were exposed down to a depth of 20 μm , after which the procedure was continued as described in Example 1. It was found that a ray-like oxide particle layer of the same quality as Example 1 had grown on the metal particles partially exposed in this manner.

In this way, it is possible to produce a particularly large surface area, so that, for use as a catalyst support, a wash coat no longer appears necessary.

It is also possible additionally to coat the oxide layer thus produced with a ceramic or metal, by sanding, slip-coating, flame spraying or plasma spraying or by other known methods. By the sequence of steps slip coating/drying/plasma spraying, it is possible to apply even virtually gas-tight oxide layers, which are firmly bonded to the metal body only via the columnar oxide particles and therefore have high stability to thermal cycling.

We claim:

1. A process for the preparation of a metallic semi-finished product based on iron and/or nickel and/or cobalt and containing 2 to 16% of aluminum, 12 to 30% of chromium and 0.01 to 4% of at least one highly reactive element from the group consisting of Y, Zr, Ti, Ce, Sm, Hf, La, Th, U, V, W, Ta, Nb. Mo. Gd, Si, Mg, Ca and/or their dispersed oxides, and normal steelmaking impurities, containing metallic columnar cystals formed at least in the surface region of the semi-finished product and columnar crystals consisting predominantly of aluminum oxide and/or chromium oxide growing out of the said metallic columnar crystals, the axes of the two types of columnar crystals being predominantly at right angles to the geometric surface of the semi-finished product, comprising solidifying a melt of the corresponding composition in a front predominantly parallel to the geometric surface at a cooling rate of $10^3$ to $10^6$ K/s, and then annealing, initially at a temperature of 800° to 1000° C. for a short time in $CO_2$ under the resulting reducing conditions, and then in the temperature range from 800° to 1000° C. for up to 25 hours in air.

2. A process as claimed in claim 1, wherein the semi-finished product is solidified by strip casting by means of at least one cooled roll.

3. A process as claimed in claim 1, wherein the semi-finished product is produced by surface melting and cooling.

4. A process as claimed in claim 1, wherein the annealing in air is carried out at a temperature in the range from 850° to 1000° C. for 4 to 20 hours.

5. A process as claimed in claim 1, wherein the annealing is carried out under reducing conditions at a temperature in the range from 880° to 980° C. for 0.5 to 4 minutes.

6. The product produced by the process of claim 1.

7. A semi-finished product as claimed in claim 6, which contains 14 to 25% of chromium.

8. A semi-finished product as claimed in claim 6 which contains 5 to 9% of aluminum.

9. A semi-finished product as claimed in claim 6, wherein the metallic columnar crystals have a mean diameter D of 5 to 50 μm and a length L of 15 μm up to the thickness of the semi-finished product, with $L:D \geqq 3$.

10. A semi-finished product as claimed in claim 9, wherein the metallic columnar crystals have a mean diameter D of 10 to 30 μm and a length L of 30 to 100 μm , with $L:D \geqq 3$.

11. A semi-finished product as claimed in claim 6, wherein the columnar oxide crystals have a mean diameter d of 0.05 to 3 μm and a length 1 of 0.5 to 15 μm , with $l:d \geqq 3$.

12. A semi-finished product as claimed in claim 11, wherein the columnar oxide crystals have a mean diameter d of 0.1 to 0.3 μm and a length of 4 to 10 μm , with $l:d \geqq 3$.

13. A process as claimed in claim 1, wherein the semi-finished product is solidified by continuous casting.

* * * * *